US005233356A

United States Patent [19]

Lee et al.

[11] Patent Number: 5,233,356

[45] Date of Patent: Aug. 3, 1993

[54] LOW SIDELOBE SOLID STATE ARRAY ANTENNA APPARATUS AND PROCESS FOR CONFIGURING AN ARRAY ANTENNA APERTURE

[75] Inventors: Jar J. Lee, Irvine; Raymond Tang, Fullerton, both of Calif.

[73] Assignee: Hughes Aircraft Company, Los Angeles, Calif.

[21] Appl. No.: 321,651

[22] Filed: Feb. 23, 1989

Related U.S. Application Data

[63] Continuation of Ser. No. 891,456, Jul. 29, 1986, abandoned.

[51] Int. Cl.[5] ..... H01Q 3/22

[52] U.S. Cl. ..... 342/368; 342/372

[58] Field of Search ..... 342/360, 376, 377, 371, 342/372

[56] References Cited

U.S. PATENT DOCUMENTS

| | | | |
|---|---|---|---|
| 3,392,393 | 7/1968 | Spitz | 342/376 |
| 3,430,242 | 2/1969 | Safran | 342/376 |
| 3,444,559 | 5/1969 | Mumford | 342/376 |
| 3,496,569 | 2/1970 | Alsbog et al. | 342/376 |
| 3,542,151 | 8/1970 | Safran | 342/371 |
| 3,553,706 | 1/1971 | Charlton | 343/777 |
| 3,576,579 | 4/1971 | Applebaum et al. | 342/371 |
| 3,706,998 | 12/1972 | Hathes et al. | 342/371 |
| 3,760,345 | 9/1973 | Hughes | 340/6 S |
| 3,811,129 | 5/1974 | Holst | 343/844 |
| 3,835,469 | 9/1974 | Chen et al. | 342/376 |
| 3,909,829 | 9/1975 | Daly | 342/377 |
| 4,052,723 | 10/1977 | Miller . | |
| 4,320,404 | 3/1982 | Chekrovna | 347/371 |
| 4,558,324 | 12/1985 | Clapp | 343/754 |
| 4,630,053 | 12/1986 | Green, Jr. et al. | 342/376 |

OTHER PUBLICATIONS

PCT Search Report for Intl Application No.: PCT/US 87/01755.

IEEE Transactions on Antennas and Propagation, vol. AP-33, No. 8 Aug. 1985, "Reducing Grating Lobes Due to Subarray Amplitude Tapering".

"Solid State Radar's Path to GaAs", D. N. McQuiddy, Jr. Texas Instruments 1982 IEEE MTT-S Digest.

*Primary Examiner*—Mark Hellner

*Attorney, Agent, or Firm*—Wanda K. Denson-Low

[57] ABSTRACT

A low sidelobe, solid state array antenna apparatus comprises a large radiating aperture divided into a large number, N, of small, closely spaced radiating apertures, each small radiating aperture having associated therewith a radiating element and a linearly polarized solid state power module. The large radiating aperture is divided into M, preferably between 3 and about 10, differently sized, elliptically shaped, concentric radiating zones superimposed, for analysis purposes, upon another. Each such zone has an output voltage amplitude, $E_i$, and semi-major and semi-minor axes of respective lengths, $a_i$ and $b_i$, each zone being considered separately in the far field equation:

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are unit vectors in the spherical coordinates and $K_o$ is the wave number associated with the radiated field. Using the far field equation, values of $E_i$, $a_i$ and $b_i$ for each zone are computed which result in the far field sidelobe peak gain being a minimum or being a specified number of dB, for example, at least about 30 dB, below the far field mainlobe gain. The values of $E_i$ in overlapping zones are summed to establish the required voltage amplitudes of the underlying power modules associated with the N radiation apertures.

31 Claims, 5 Drawing Sheets

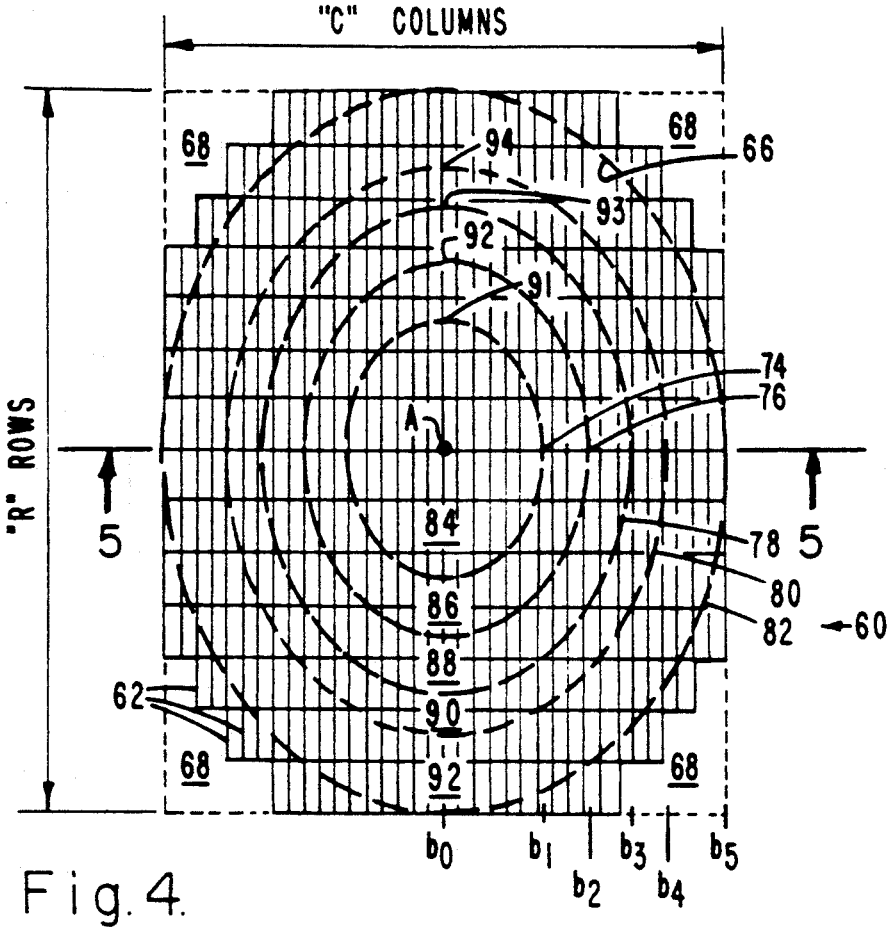
Fig. 4.
Fig. 5.
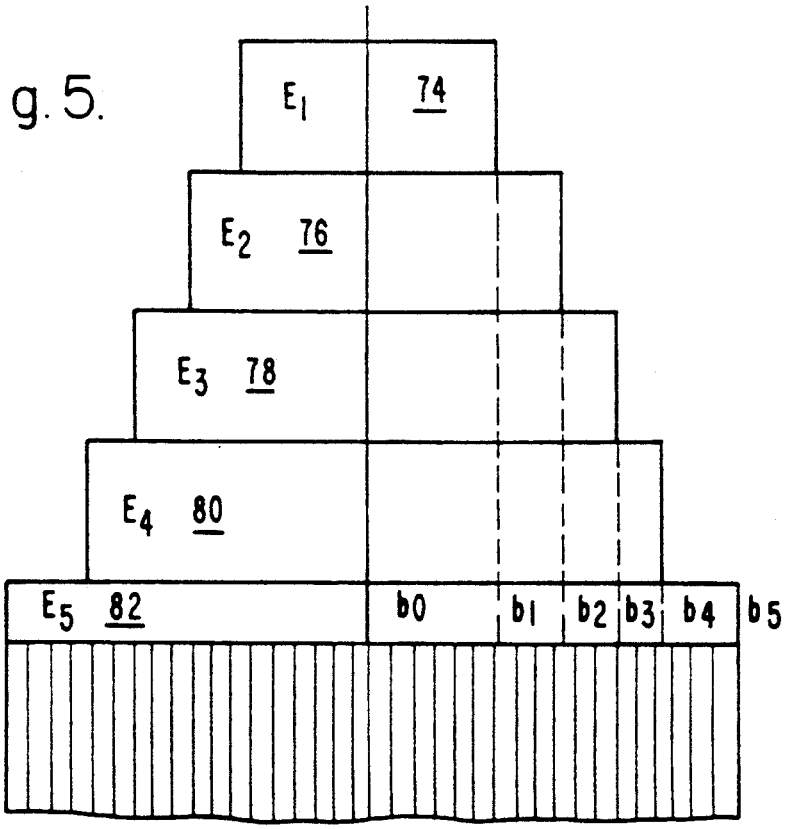

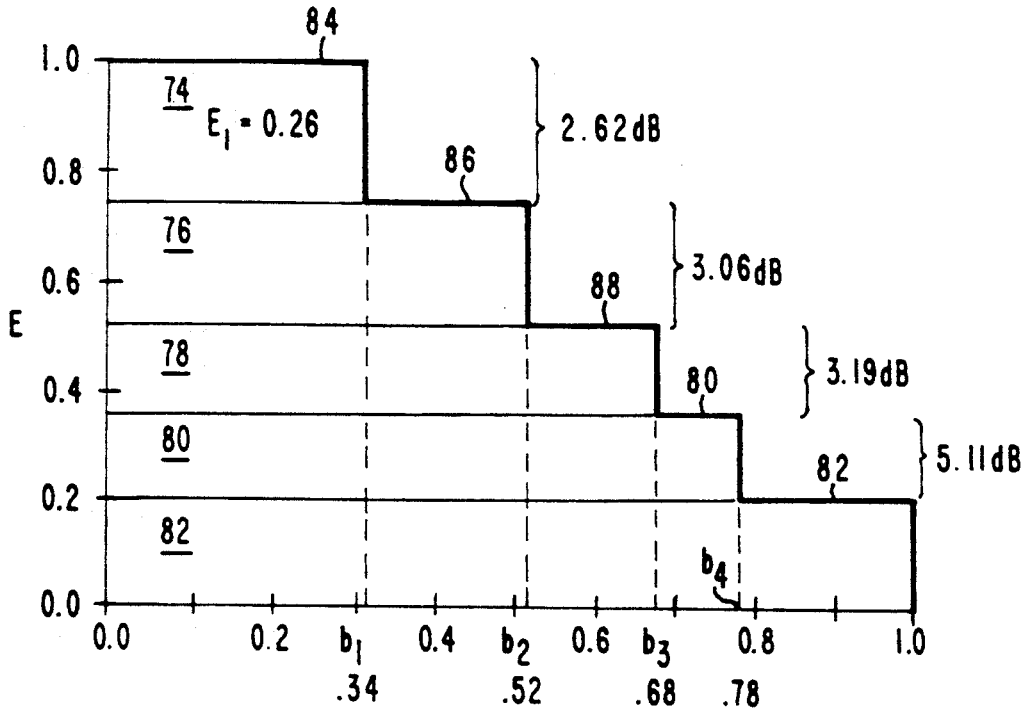
Fig. 6.
Fig. 7.
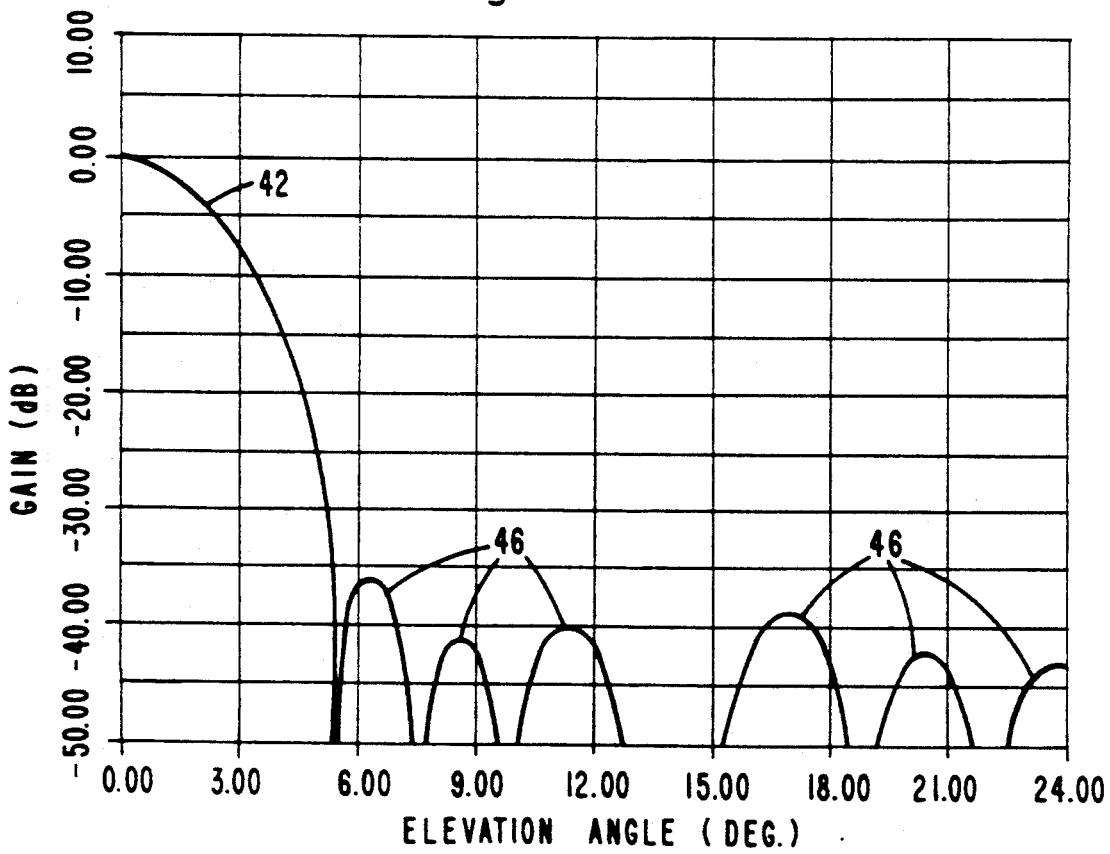

LOW SIDELOBE SOLID STATE ARRAY ANTENNA APPARATUS AND PROCESS FOR CONFIGURING AN ARRAY ANTENNA APERTURE

This application is a continuation of application Ser. No. 891,456, filed Jul. 29, 1986 now abandoned.

BACKGROUND OF THE INVENTION

1. Field of the Invention

The present invention relates generally to the field of solid state, active aperture array antennas for radar, and more particularly to apparatus and methods for reducing sidelobe radiation by such antennas.

2. Discussion of the Background

Radar antennas are well known to radiate microwave radiation in a braod pattern which, for a directed antenna, includes a narrow mainlobe and wide sidelobes of radiation. By common definition, the mainlobe is the central lobe of a directional antenna's radiation pattern, the sidelobes referring to the lesser lobes of progressively decreasing amplitude on both sides of the mainlobe and often extending rearwardly of the mainlobe.

Radar antenna aperture configuration generally determines the extent and relative magnitude of the associated sidelobes; however, the gain of the strongest one of the sidelobes is typically only about 1/64 that of the mainlobe. In terms of decibels, the strongest sidelobe gain is typically down about 18 dB from the associated mainlobe gain. Gains of the other sidelobes are usually considerably smaller than that of the strongest sidelobe. Although sidelobe gain is typically much smaller than mainlobe gain, because of the large solid angle into which sidelobes radiate, as compared to the small solid angle into which the mainlobe radiates, typically about 25 percent of the total power is radiated by a uniformly illuminated radar antenna in the sidelobes.

Ordinarily, sidelobe radiation provides no useful function and in addition to representing wasted radiating power has other serious disadvantages. For example, radar clutter from sidelobe returns increases the difficulty of discriminating targets from background. Another very significant disadvantage of sidelobe radiation is that such radiation can, in a military environment, be utilized by hostile forces for electronically jamming the radar and can also be used for positionally locating and for guiding munitions to the radar. In this regard, although mainlobe radiation is ordinarily much greater than sidelobe radiation, its relatively small solid angle of radiation and its directionality makes mainlobe jamming, radar location and munitions direction more difficult.

For these and other reasons, the reduction or suppression of radar sidelobe radiation is, particularly in military radar, important and military procurement documents establishing rigid limits on sidelobe radiation are not uncommon.

It is generally known that sidelobe radiation can be suppressed in array-type radar antennas by "tapering" the illumination over the aperture so that individual radiation-emitting elements near the side edges of the array radiate less energy than do other elements closer to the center of the array. Power may, for example, be individually applied to emitting elements of the array, so that the radiation energy distribution across the array, in at least one direction, is substantially Gaussian.

Radar arrays have, until quite recently, been "passive" types in which each radiating element in the array is provided power from a large, common power source. For such passive arrays, tapering of the radiation output, or, as it is sometimes termed, tapering of array illumination, is comparatively easy to implement by the use of restrictive branching from the power source to the radiating elements, such that progressively lower power is provided to elements further from the array center.

More recently, however, there has been great interest in developing active aperture arrays in which each radiating element, or a subgroup of elements, in the array is driven by a separate, small, solid state power supply or module. Active arrays have numerous actual and potential advantages over passive arrays. As an example, the power modules of the active arrays, being physically dispersed across the array, can be cooled more efficiently and effectively than the single, high power source of a corresponding passive array. Moreover, within a large active array, a comparative large number of power modules can fail or malfunction without substantially impairing effectiveness of the antenna. In contrast, failure or malfunction of the common power source in a passive array incapacitates the entire antenna.

According to theory, the providing of very smoothly tapered illumination of passive array antennas should be possible by the use of many (about 20 or more) different groups of power modules, each group having a different power output. In reality, however, the use of many different power groups of modules is not practical because such construction adds substantially to the cost of producing the arrays and causes subsequent maintenance and logistical support problems. As an illustration, if twenty different power modules groups were to be used in an array, supplies of all twenty different type modules would have to be stocked wherever any array maintenance and repair activities are expected to be needed.

As a result of costs and problems involved with using a large number of different power module groups in active arrays, sidelobe reduction has generally been attempted using only a relatively few different power module groups which have heretofore provided only coarsely tapered array illumination and relatively poor side lobe reduction. The selection of power module operating levels and their arrangement has, so far as is known to the present inventors, been previously made merely by approximately fitting the resulting, staircase-shaped distribution, having only a few steps, to an optimal distribution which may, for example, be in the bell-shape of a Gaussian distribution. Such fitting of an actual, stepped distribution to an optimum distribution curve has not heretofar, also so far as is known to the present inventors, been based upon any rigorous, systematic analysis and has not, therefore, except possibly in isolated, accidental cases, resulted in minimal sidelobes. Nor have such heretofore used curve-fitting approaches enabled specific sidelobe radiation levels to be predicted or designed to, as is often required to meet procurement specifications.

As a result, to satisfy present and anticipated future low sidelobe requirements for solid state active array antennas, improvements are required in the design of such antennas, and specifically in processes for the systematic selection of power module operating levels and physical arrangements of power modules operating at different power levels so as to provide low sidelobes. It is to such a systematic approach for power module operating levels and arrangements that the present invention is directed.

SUMMARY OF THE INVENTION

According to the present invention, a low sidelobe solid state, phased array antenna apparatus, having a far field mainlobe and sidelobe radiation pattern, comprises an antenna aperture formed of a large number, N, of small, closely spaced radiating apertures; N small, linerly polarized radiating elements, each operatively associated with a corresponding small radiating aperture for radiating microwave energy therethrough; and a number, preferably equal to the number, N, of solid state power modules, each operatively associated with at least one corresponding radiating element for providing power thereto. The power modules are divided into a number, M, of specifically arranged groups of modules, the number M preferably being between 3 and about 10, being more preferably between 3 and about 7 and being most preferably equal to about 5. The output voltage amplitude of each of the power modules is the same in any group of modules, but is substantially different in different groups of modules. The voltages amplitudes of the power modules for the different module groups and the boundaries of the M groups of modules are selected so as to cause the far field sidelobe peak gain to be down at least about 30 dB from the associated far field mainlobe gain of the array.

According to an embodiment, the M groups of power modules are concentrically arranged around a central point of the array so that the voltage amplitudes of the power modules in the groups of modules decrease with increasing distance from the array central point. Also, according to an embodiment, the outer boundary of each group of modules is elliptically shaped, having respective semi-major and semi-minor axes $a_i$ and $b_i$. It should be pointed out that a circular boundary is just a special case of this analysis wherein the aspect ratio $a_i/b_i$ is equal to one. Also, without loss of generality, the shape of each elliptical boundary can be chosen to have the same aspect ratio for convenience of design. The output voltage amplitudes and the arrangement of the groups of power modules are selected by treating the module groups as being formed of, or comprising, a superposition of M overlapping, elliptically-shaped zones, each such zone having the same boundary as a corresponding one of the module groups. Each of the M zones has associated therewith a voltage amplitude, $E_i$. The voltage amplitude of the power modules in each group of modules is determined by treating the M module voltage amplitudes as a superposition of the voltage amplitudes, $E_i$, of the corresponding overlapped zones. In conjunction therewith, the zone voltage amplitudes, $E_i$, and the group boundary semi-major and semi-minor axes, $a_i$ and $b_i$, respectively, are selected by application of the following expression for the far field.

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are the unit vectors in the spherical coordinate system and $k_o$ is the wave number equal to $2\pi/\lambda$, with $\lambda$ being the wavelength associated with the radiated field.

A corresponding process is provided for configuring low sidelobe array antennas, the process comprising forming an array antenna aperture from a large number, N, of small radiating apertures, providing for each radiating aperture a radiating element and a power module for supplying power to the radiating element, dividing the power modules into M different output voltage level groups and selecting the configuration of the groups of power modules and the output voltages amplitudes thereof so as to cause the far field sidelobe gain to be down at least about 30 dB from the corresponding far field mainlobe gain.

The process includes treating the arrangement of the M groups of modules as a superposition of M overlapping, elliptical radiating zones having the same boundries as the power module groups, the output voltages amplitude for any group of modules being equal to the sum of the voltage amplitudes, $E_i$, of the superimposed radiating zones, the semi-major and semi-minor axes $a_i$ and $b_i$ of the zones and the voltage amplitude levels $E_1$ thereof being selected in accordance with the above equation to provide a far field sidelobe gain which is at least about 30 dB down from the associated far field mainlobe gain.

BRIEF DESCRIPTION OF THE DRAWINGS

A better understanding of the present invention may be had by considering the accompanying drawings in which:

FIG. 4 is a diagram depicting the manner in which a generally rectangular solid state active array antenna is divided into a series of M concentric, overlapping elliptical power module zones, each such zone having a different power level;

FIG. 5 is a diagram showing, relative to an array cross-section taken generally along line 5—5 of FIG. 4, how the aperture illumination taper is provided by superimposing different voltage levels of power modules in the different module zones of FIG. 4;

FIG. 6 is a diagram, similar to right hand portions of the diagram of FIG. 5, showing, for a particular array configuration and sidelobe radiation requirement, normalized power levels for five power module zones, the corresponding, normalized zone boundary dimensions being also indicated;

FIG. 7 is a graph plotting far field mainlobe and sidelobe gain vs angle from broadside axis for the conditions shown in FIG. 6; idealized, elliptical aperture zones being assumed.

DESCRIPTION OF THE PREFERRED EMBODIMENT

Figure 1:
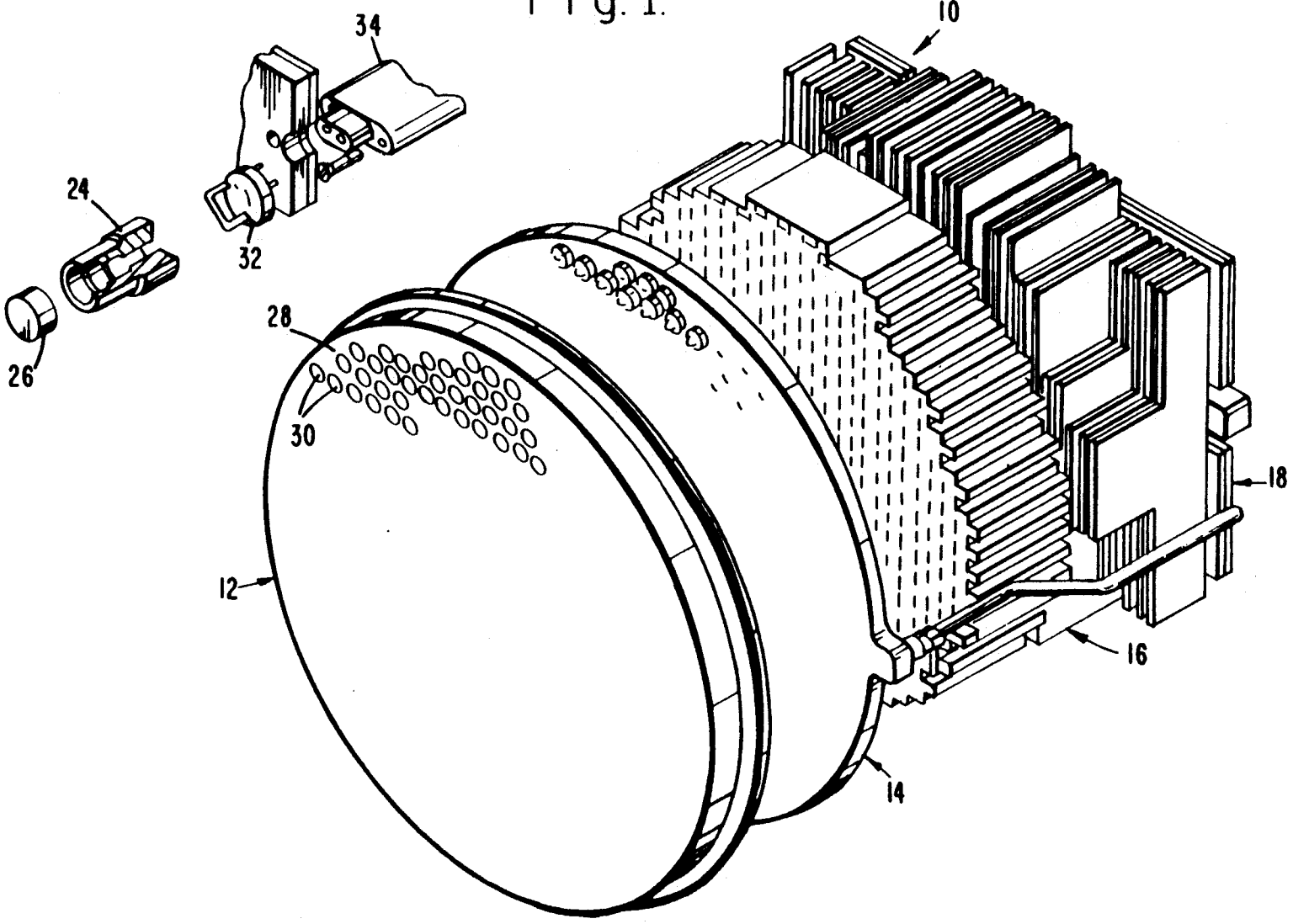
FIG. 1 is an exploded perspective of an exemplary solid state, active array antenna with which the present invention may be used to advantage.

There is shown in FIG. 1, in exploded form, an exemplary, solid state, active array antenna 10 of the general type with which the present invention may be used to advantage. Comprising antenna 10, which is shown as an aircraft-mounted type, are an aperture assembly 12, a cooling liquid plate assembly 14, a solid state power module assembly 16 and a stripline feed assembly 18. Included in aperture assembly 12 is a large number of small radiating elements 24, each of which has disposed therein a dielectric filler 26. Defined in a face 28 of aperture assembly 12 is a large number of openings 30, each of such openings being associated with one of radiating elements 24. Mounted on cooling plate assembly 14 are a number of loop assemblies 32, each of which is also associated with one of radiating elements 24. A large number of solid state power modules 34 comprise power module assembly 16, each such module preferably, but not necessarily, powering only a single associated radiating element 24.

Figure 2:
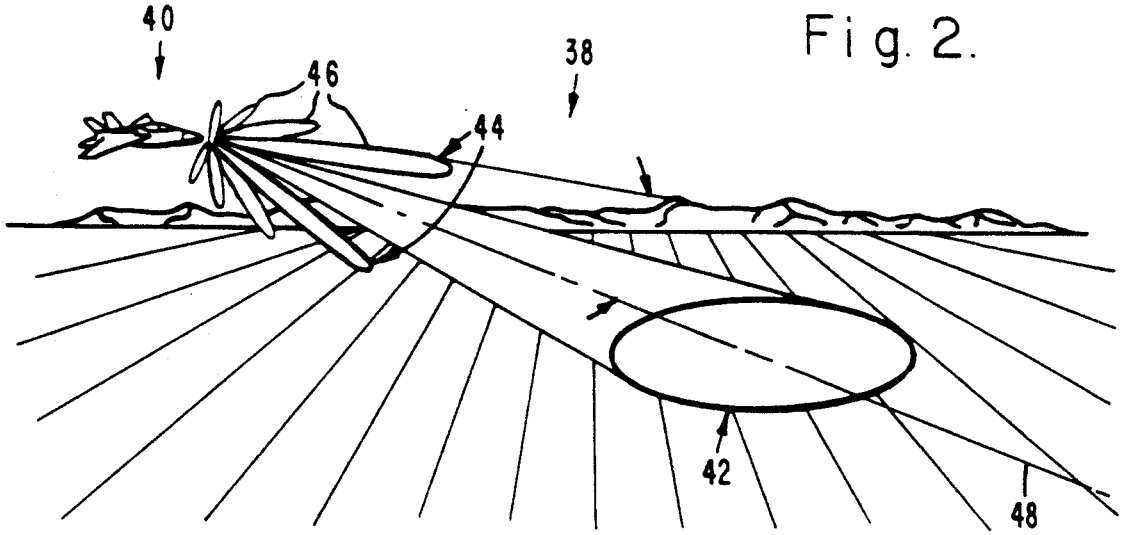
FIG. 2 is a pictorial drawing of the radiation pattern of a typical airborne radar, showing mainlobe and sidelobe portions of the radiation pattern.

The present invention is principally directed towards providing preselected voltage operating levels of power modules (corresponding to modules 34) and the physical arrangement of such modules in an assembly (corresponding to module assembly 16) so that the far field radiation from the antenna exhibits very low sidelobes. With respect to sidelobes, FIG. 2 illustrates a typical radiation pattern 38 associated with a radar carried by an aircraft 40. The airborne radar involved may, for example, comprise a solid state active array similar to array 10 depicted in FIG. 1. As shown in FIG. 2, radiation pattern 38 comprises a narrow, beam-shaped mainlobe 42 and smaller, fan-shaped sidelobes 44 on each side of the mainlobe. Sidelobes 44 comprise several different lobes 46 which fan out at different angles, $\alpha$, relative to a main beam axis 48; typically the sidelobes diminish in intensity as the angle, $\alpha$ increases. It can further be seen from FIG. 2 that some of lobes 46 extend rearwardly relative to mainlobe 42, the angles, $\alpha$, associated therewith being greater than 90°.

As more particularly described below, the present invention relates to a process for configuring a solid state, active array so that the far field sidelobe gain is down a very substantial amount, preferably at least about 30 dB down, from the far field mainlobe gain. In general, the reduced sidelobes provided by the present invention is accomplished by tapering the radiating illumination in a relatively few, precisely determined steps.

Figure 3:
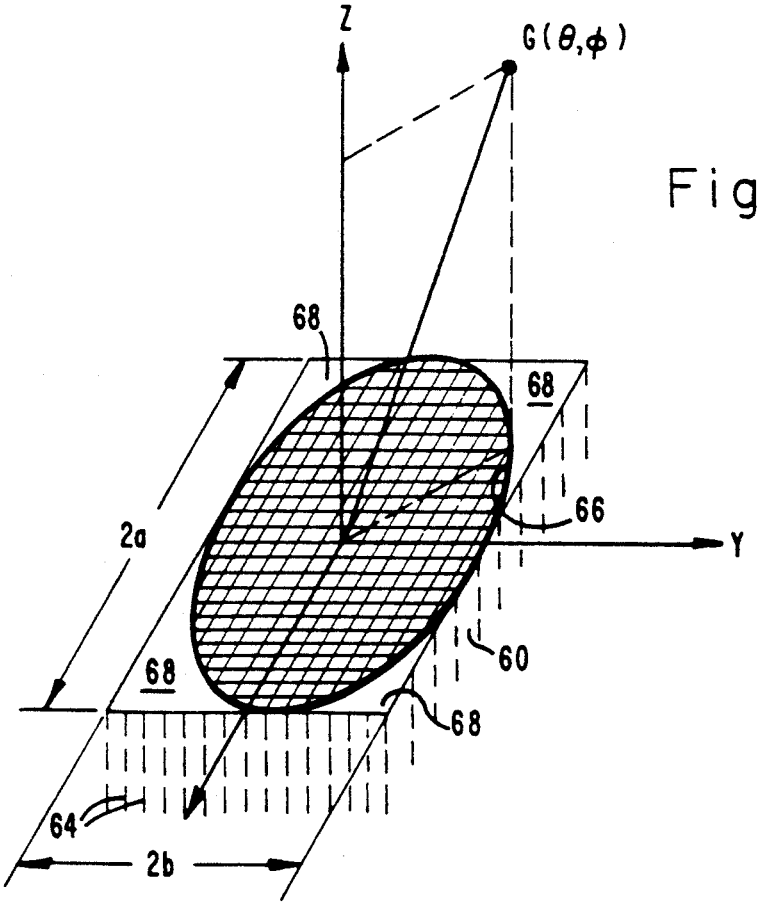
FIG. 3 is a diagram depicting the coordinate system used to specify the coordinates of the far field relative to a radiating antenna.

For purposes of further describing the invention, the more general case of a rectangular, solid state active array 60, depicted in FIGS. 3–5, is considered. Array 60 corresponds generally to array 10 (FIG. 1), insofar as general construction is concerned.

Also, for purposes of illustrating the invention, it may be assumed that array 60 has rectangular dimensions $2a$ and $2b$, and has R rows and C columns of linearly polarized, rectangular radiating elements 62. Associated with element 62 is a power module 64 (shown in phantom lines).

It is, however, assumed, for purposes of simplifying the following computations, that array 60 has an elliptically (instead of a rectangular) radiating aperture 66, it having been determined by the present inventors that array corner regions 68 contribute only negligibly to sidelobes. For purposes of the following description, the far field, G, associated with radiating aperture 66 is considered, the far field at any point defined by angles $\theta$ and $\phi$ being generally identified as $G(\theta,\phi)$ in FIG. 3.

A principal feature of the present invention is the dividing, for analysis purposes, of radiating aperture 66 into a relatively few, superimposed elliptical zones around a central point "A", and the selection of zone boundary axes $a_i$, $b_i$ and the zone voltage amplitudes, $E_i$, associated therewith in a manner providing a tapered illumination of the aperture which assures very low, far field sidelobes.

Preferably the number of elliptical zones selected varies between 3 and about 10 and more preferably between 3 and only about 7. Insufficient illumination tapering is considered to be provided using less than 3 zones and although smoother tapering can be provided by use of more than about 7 zones, the cost of using more than that number of different types of power modules is costly and has moreover, been found by the present inventors to be unnecessary for achieving very low sidelobes. For specific purposes of illustrating the invention, the number of zones shown and described is 5; however, any limitation to the use of about 5 zones is neither intended nor implied.

First through fifth concentric, progressively larger elliptical zones 74, 76, 78, 80 and 82, respectively, are thus selected, the zones having semi-major and semi-minor axes equal, respectively, to $a_1$, $a_2$, $a_3$, $a_4$, and $a_5$ and $b_1$, $b_2$ $b_3$, $b_4$, and $b_5$ (FIG. 4). First zone 74 is the smallest zone and fifth zone 82 is the largest zone and completely fills aperture 66, dimensions $a_5$ and $b_5$ being, therfore, respectfully equal to aperture dimensions a and b (FIG. 3).

As can be seen from FIG. 5, which corresponds to a transverse output voltage cross-section of array 60, zones 74, 76, 78, 80 and 82 are, for analysis purposes, considered as stacked (or superimposed) upon one another, with the fifth, largest zone 82 at the bottom and the first, smallest zone 74 at the top. Associated with each zone 74, 76, 78 and 80 and 82 is a different voltage amplitude, $E_i$, amplitude $E_1$ being associated with zone 74, $E_2$ with zone 76, $E_3$ with zone 78, $E_4$ with zone 80 and $E_5$ with zone 82. In regions where two or more zones 74–82 overlap, the voltage amplitudes, $E_i$, are added to establish power module voltage. For example, in a central, elliptical region 84, defined by first zone 74, the combined voltage amplitude of the stacked zones 74–82 required to be provided by underlying power modules 60 is equal to $E_1+E_2+E_3+E_4+E_5$. In an annular region 86 of second zone 76 outside of first zone 74, the voltage amplitude required to be provided by underlying power modules 64 is equal to $E_2+E_3+E_4+E_5$; in an annular region 88 of third zone 78 outside of second zone 74, the voltage amplitude required to be provided by the underlying power modules is equal to $E_3+E_4+E_5$. In turn, in an annular region 90 of fourth zone 80 outside of zone 78, the voltage required to be provided by underlying power modules 64 is $E_4+E_5$; outside of zone 80, in an annular region 92 of fifth zone 82, underlying power modules 64 are required to provide a voltages amplitude equal only to $E_5$. However, by known principles of superposition, each zone 74–82 can be treated separately as providing only a single, corresponding voltage amplitude $E_1$--$E_5$.

The present process treats all zone axis dimensions, $a_i$, $b_1$, zone voltage amplitudes, $E_i$, as independent variables At least one set of values for these variables is computed which will provide, as may be required, either minimum sidelobes or a sidelobe gain which is a preselected number of dB less than the corresponding mainlobe gain. These independent variables $a_i$, $b_i$ and $E_i$ are computed, for numerous $G(\theta, \phi)$ points, by the equation:

$$G(\theta,\phi) = [f(\theta,\phi)(a_\theta \cos\theta - a_\phi \sin\phi \cos\theta)]^2, \quad (1)$$

$$\text{wherein } f(\theta,\phi) = \sum_{i=1}^{M} 2\pi\, a_i\, b_i\, E_i\, J_1(u_i)/u_i, \quad (2)$$

$$u_i = (k_o\, a_i \sin\theta)\sqrt{\cos^2\phi + (b_i^2/a_i^2)\sin^2\phi}\ , \quad (3)$$

and further wherein $J_1(u_i)$ is the first order Bessel function, $k_o$ is the wave number associated with the radiation and $\hat{a}_\theta$ and $\hat{a}_\phi$ are the unit vectors in the sperical coordinate system.

To determine the optimum set of parameters ($a_i$, $b_i$, $E_i$) for low sidelobes, standard techniques of gradient search can be employed. In the optimization process an initial set of parameters is chosen as a starting point, and a present maximum sidelobe level (such as −30 dB) is selected as a performance criterion. Then the antenna far field pattern with the initial set of input parameters can be calculated by using Equation (1). Next the total power of all the sidelobes that exceed the present level, being defined as the error, is computed. After this a small variation of one of the parameters, either a positive or negative increment, is introduced and the error is recomputed. By examining the trend of the error, and hence the gradient (rate of change), one can decide which way the following step of variation should be implemented. The process is repeated for this parameter until a local minimum in the error is obtained. By the same procedure the iteration process is carried out for all other parameters until the error is reduced to an acceptable level. This optimization process can be readily accomplished by using a computer. By way of specific example, again with no limitations being thereby intended or implied, the present inventors have determined for M equal to 5 (that is, for five aperture zones), the optimum zone boundaries, $a_i$, $b_i$, and output voltage amplitudes, $E_i$. These values are shown below in Table 1, wherein $a=a_5=1.3$ meters and $b=b_5=0.87$ meters, the sum of $E_1+E_2+E_3+E_4+E_5$ is normalized to 1.0 and the radiation frequency is 3.25 GHz. Furthermore, for simplicity of mathematical derivation, the aspect ratio, $b_i/a_i$, for each zone is identical to that of each other zone.

TABLE 1

| | |
|---|---|
| $a_1$ | .44 m |
| $a_2$ | .68 m |
| $a_3$ | .88 m |
| $a_4$ | 1.01 m |
| $a_5$ | 1.3 m |
| $b_1$ | .30 m |
| $b_2$ | .46 m |
| $b_3$ | .60 m |
| $b_4$ | .68 m |
| $b_5$ | .87 m |
| $E_1$ | 0.26 |
| $E_2$ | 0.22 |
| $E_3$ | 0.16 |
| $E_4$ | 0.16 |
| $E_5$ | 0.20 |

FIG. 6, directly corresponds to the righthand half of FIG. 5 and depicts, relatively to scale and for the $b_i$ dimensions normalized to $b=b_5=1$, the corresponding, computed voltage amplitude, $E_i$, for each of the five zones 74, 76, 78, 80 and 82. Also shown in FIG. 6 is the dB value associated with the difference in power level across each boundary: 2.62 dB with zone 74, 3.06 dB with zone 76, 3.1 dB with zone 78 and 5.11 dB with zone 80.

For the computed $a_i$, $b_i$, $E_i$ values listed in Table 1, there is plotted in FIG. 7 antenna pattern gain (in dB) against elevation angle, $\theta$ as measured from the broadside axis. From FIG. 7 it can be seen that the gains of all sidelobes 46 (shown shaded) are down at least about 36 dB from the peak (0°) gain of mainlobe 42 over the entire visible radiation range.

In the foregoing, it has been assumed, for computations involving Equation 1, that the boundaries of the five elliptical zones 74, 76, 78, 80 and 82 are perfectly elliptical, as would be the case if there were an infinite number of infinitely small power modules 64 distributed over antenna elements 62. In reality, however, each radiating zone intersects a finite, though usually large, number of radiating elements 62 so that the zone boundaries are more accurately approximated by a discontinuous, stepped shape, (FIG. 4). The question then arises as to which of two adjacent zones the intersected radiating elements 62 (and corresponding power modules 64) should be allocated and also whether allocation to one zone or another makes any significant difference with respect to sidelobe gain reduction.

Figure 8:
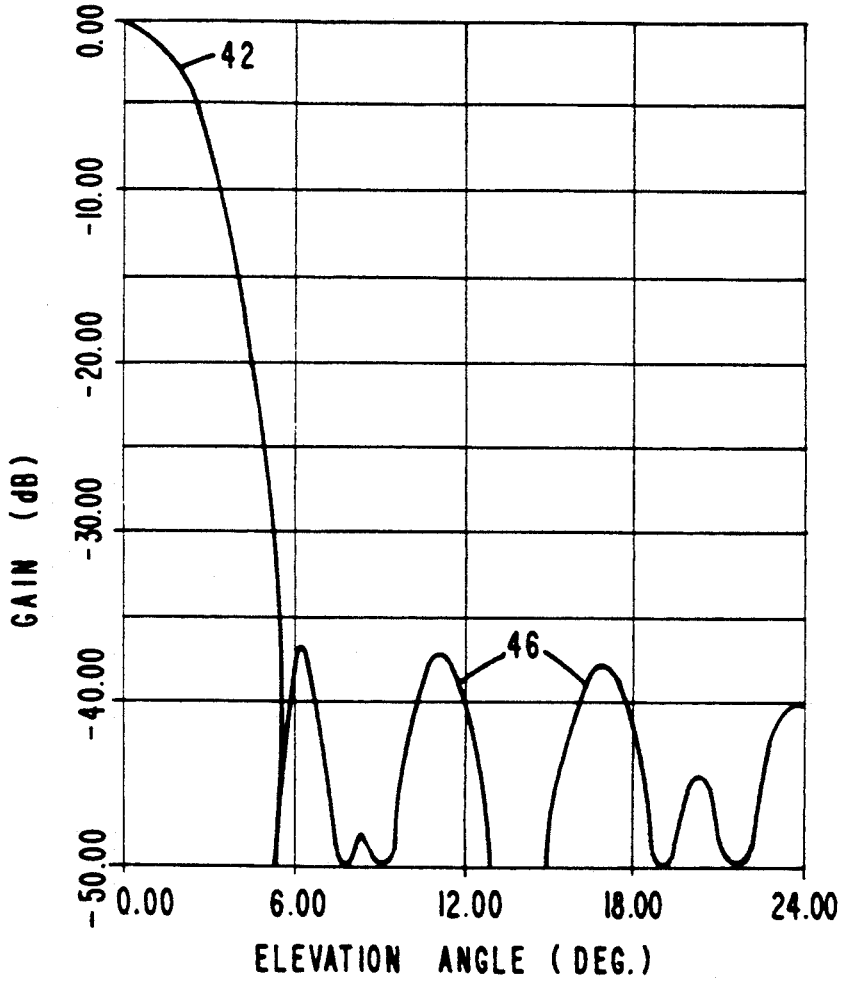
FIG. 8 is a graph plotting far field mainlobe and sidelobe gain vs angle from broadside axis for conditions in which stepped zone boundaries corresponding to actual module lattice configuration are assumed.

To answer this question, a specific array pattern, with actual element spacing and lattice structure taken into account, was used by the present inventors to compute aperture zone parameters $a_i$ and $b_i$ and voltage amplitudes, $E_i$. For such purposes, the actual geometric configuration of a proposed solid state radar array, having an array size of 2.6 by 1.75 meters and having 1188 rectangular radiating elements, was assumed. It was futher assumed that the zone boundaries followed actual boundries of the radiating apertures. Values of $a_1$, $b_1$ and $E_i$ for minimum sidelobes were obtained for such an array configuration by operation of Equation 1. The computed gain VS elevation angle is plotted in FIG. 8 which shows that the highest sidelobe gain is down at least about 37 dB from the peak mainlobe gain. A comparison of FIGS. 7 and 8 thus reveals that although the sidelobe pattern is slightly different in actual conditions (FIG. 8) as compared to that of the idealized conditions (FIG. 7), the sidelobe gains are nevertheless about the same in both cases.

Although there have been described above an apparatus and a method for configuring a solid state, active array antenna aperature so as to provide about a −30 to −35 dB peak sidelobe gain by using only a few different power module groups, for purposes of illustrating the manner in which the invention can be used to advantage, it is to be understood that the invention is not limited thereto. Accordingly, any and all variations and modifications which may occur to those skilled in the art are to be understood to be within the scope and spirit of the invention as defined in the appended claims.

What is claimed is:

1. A low sidelobe, phased array antenna comprising:

a) an aperture assembly providing a large number of small, closely spaced apertures, each aperture being coupled to receive linearly polarized radio frequency energy from an individual radiating element associated only with said aperture;

b) a power module assembly including a plurality of power modules, said power module assembly amplifying radio frequency energy to provide each radiating element with radio frequency energy at a preselected power level, c) said power module assembly providing radio frequency energy to the radiating elements at a plurality of power levels, the power level of the radio frequency energy applied to each radiating element being selected to provide groups of radiating elements in which each radiating element receives radio frequency energy at the same one of said plurality of power levels, and d) said groups of radiating elements being formed to provide a plurality of concentric, substantially elliptically shaped radiating zones of radiating elements having a preselected power level.

2. An array antenna as recited in claim 1 wherein said concentric radiating zones are centered at the center of aperture assembly.

3. An array antenna as recited in claim 2 wherein said plurality of power modules includes a power module associated with each one of said radiating elements, said power module amplifying radio frequency energy to provide each radiating element with radio frequency energy at a preselected power level.

4. An array antenna as recited in claim 1 wherein the power levels for said radiating zones decreases with distance of said radiating zones from the center of the zones.

5. An array antenna as recited in claim 3 wherein the power levels for said radiating zones decreases with distance of said radiating zones from the center of the zones.

6. An array antenna as recited in claim 1 wherein said substantially elliptically shaped radiating zones are substantially circular.

7. An array antenna as recited in claim 5 wherein the number of said radiating zones is between 3 and 10.

8. An array antenna as recited in claim 1 wherein the number of said radiating zones is between 3 and 10.

9. An array antenna as recited in claim 2 wherein the number of said radiating zones is between 3 and 10.

10. An array antenna as recited in claim 3 wherein the number of said radiating zones is between 3 and 10.

11. An array antenna as recited in claim 4 wherein the number of said radiating zones is between 3 and 10.

12. A low sidelobe, solid state, phased array antenna apparatus having a far field mainlobe and sidelobe radiation pattern, the array antenna comprising:

a) an antenna aperture formed of a large number, N, of small, closely spaced radiating apertures;

b) a number, equal to the number N, of linearly polarized radiating elements, each of which is operatively associated with a corresponding one of the small radiating apertures for radiating microwave energy therethrough; and c) a number of solid state power modules, each of which is operatively associated with at least one of the radiating elements for providing power thereto, the number of power modules being divided into a number, M, of groups of power modules, the number M being between 3 and about 10 and being much less than the number N, the output voltage amplitudes of each of the power modules being substantially the same for any group of modules and being substantially different for different groups of modules, the output voltage amplitudes of the power modules for the M different groups of modules and the boundaries of the M different groups of modules being selected so as to cause the far field sidelobe gain of the array to be down at least about 30 dB from the associated far field mainlobe gain of the array, and wherein the M groups of power modules are concentrically arranged around a central point of the array so that the voltage amplitudes of the power modules decrease with increasing distance of the groups from said central point, and the outer boundary of each of the M groups of power modules is elliptically shaped, each said boundary having a semi-major axis of length $a_i$ and a semi-minor axis of length $b_1$, where the subscript "i" refers to the ith boundary.

13. A low sidelobe, solid state, phased array antenna apparatus having a far field mainlobe and sidelobe radiation pattern, the array antenna comprising:

a) an antenna aperture formed of a large number, N, of individual, closely spaced radiating apertures;

b) a number, equal to the number N, of radiating elements, each of which is operatively associated with a corresponding one of the radiating apertures for radiating microwave energy therethrough; and c) a plurality of separate, active solid state power modules, each of which is operatively associated with at least one of the radiating elements for providing power thereto, the plurality of power modules being divided into a number, M, of progressively larger, elliptically-shaped groups of power modules, the M groups of power modules being arranged around a central point of the array, the output voltage amplitude of each of the power modules being substantially the same in any one of the M groups of modules and being substantially different in different groups of the modules, the M groups of modules being arranged so that the voltage amplitudes of the power modules in the groups of modules decreases with increasing distance from said central point.

14. A process for configuring a low sidelobe, solid state, phased array antenna, the process comprising:

a) forming an array antenna aperture of a large number, N, of small, closely spaced radiating apertures;

b) providing for each of the small radiating apertures a radiating element, N radiating elements being thereby provided;

c) providing for each of the radiating elements a separate, active solid state power module;

d) dividing the power modules into M different elliptically-shaped power module groups of progressively larger sizes, the output voltage amplitudes of each of the power modules being substantially the same within any group of modules and being substantially different for different groups of modules; and e) arranging the M groups of power modules about a common point of the array such that the output voltage amplitudes of the power modules in the respective M different groups decrease with increasing distance of the respective groups from said common point.

15. A process for configuring a low sidelobe, solid state phased array antenna, the process comprising:

a) providing, for an array antenna aperture, a large number, N, of small, closely spaced radiating apertures;

b) providing for each of the N small radiating apertures a radiating element and a solid state power module, a number N of radiating elements and N power modules being thereby provided;

c) dividing the array antenna aperture into a number, M, of differently sized, overlapping concentric zones of elliptical shape, each of said zones having a semi-major axis of length, $a_i$, and a semi-minor axis of length, $b_i$;

d) selecting, by use of the following far field equation, values of $E_i$, $a_i$ and $b_i$ which cause the far field sidelobe gain of the array to be down by at least about 30 dB from the corresponding far field mainlobe gain;

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are unit vectors in the sperical coordinate, $k_o$ is the wave number associated with the radiated field and the subscript "i" refers to the ith zone;

e) combining the $E_i$ values for overlapping areas of said zones and selecting the output voltages amplitudes of power modules underlying the overlapped zones to be equal to said combined $E_i$ values.

16. A low sidelobe, solid state, phased array antenna apparatus having a far field mainlobe and sidelobe radiation pattern, the array antenna apparatus comprising:

a) an antenna aperture formed of a large number, N, of individual, closely spaced radiating apertures;

b) a number, equal to the number N, of radiating elements, each of which is operatively associated with a corresponding one of the radiating apertures for radiating microwave energy therethrough; and c) a number of solid state power modules, each of which is operatively associated with at least one of the radiating elements for providing power thereto, the number of power modules being divided into a number, M, of groups of power modules, the number M is between 3 and about 7 and is much less than the number N, the M groups of power modules being arranged in a concentric pattern around a central point of the array, the output voltage amplitude of each of the power modules being substantially the same in any one of the M groups of modules and being substantially different in different groups of the modules, the M groups of modules being arranged so that the voltage amplitudes of the power modules in the groups of modules decreases with increasing distance from the central point;

the output voltage amplitudes of the power modules in the different groups of power modules and the boundaries of the different groups of power modules being selected, in combination, to cause the far field peak sidelobe gain of the array to be down at least about 30 dB from the corresponding far field mainlobe gain of the array; and wherein the outer boundary of each of the M groups of power modules is elliptical shaped, each said boundary having a semi-major axis of length $a_i$ and a semi-minor axis of length $b_i$ and wherein the M groups of modules are treated as comprising a superposition of M, elliptically-shaped zones having the same boundaries as corresponding ones of the groups of modules, each of the M zones having associated therewith a different voltage amplitude $E_i$, the voltage amplitudes of the power modules in each of said groups of modules being a superposition of the different voltage amplitudes, $E_i$, of each the overlapping zones associated with each of the groups, wherein the subscript "i" refers to the ith zone.

17. A process for configuring a low sidelobe solid state, phased array antenna, the process comprising:

a) forming an array antenna aperture of a large number, N, of small, closely spaced radiating apertures;

b) providing for each of the small radiating apertures a radiating element, N radiating elements being thereby provided;

c) providing for each of the radiating elements a solid state power module;

d) dividing the power modules into M different power module groups, the number M being between 3 and about 10, and being much less than the number N;

e) arranging the M groups of power modules so that the outer boundaries thereof are substantially elliptically shaped, each boundary having a semi-major axis of length $a_i$ and a semi-minor axis of length $b_i$, wherein the subscript "i" refers to the ith boundary; and f) selecting the configuration of the M groups of power modules and the output voltage amplitude of the power modules in each of the M groups of modules so as to cause the far field peak sidelobe gain to be down at least about 30 dB from the corresponding far field mainlobe gain of the array.

18. A process for configuring a low sidelobe, solid state, phased array antenna, the process comprising:

a) providing, for an array antenna aperture, a large number, N, of small, closely spaced radiating apertures;

b) providing for each of the small radiating apertures a radiating element, N radiating elements being thereby provided;

c) providing for each of the N radiating elements a solid state power module;

d) dividing the power modules into M different power module groups, the number M being between 3 and about 7 and being much less than the number N, the output voltage amplitude of all the power modules in any of the M groups of modules being substantially the same and the output voltage amplitudes of power modules in different groups of modules being different;

e) arranging the M groups of power modules in a concentric pattern around a central point of the array so that the output voltage amplitudes of the M groups of power modules decrease with increasing distance from said central point;

f) arranging the M groups of power modules so that the outer boundary of each said groups is substantially elliptical in shape, each boundary having a semi-major axis of length $a_i$ and a semi-minor axis of length $b_i$ and treating each of the M groups of power modules as a superposition of M elliptically shaped, overlapping zones having the same boundaries as corresponding ones of the M groups of power modules, each of the M zones having associated therewith a voltage amplitude, $E_i$, and treating the voltage amplitude of each of the M groups of modules as an additive superposition of the voltage amplitudes, $E_i$, of the corresponding overlapping zones, wherein the subscript "i" refers to the ith zone; and g) selecting the output voltage amplitudes of the power modules of the M groups of power modules and the boundaries of the M groups of power modules so as to cause the far field sidelobe gain of the array to be down at least about 30 dB from the corresponding far field mainlobe gain of the array.

19. The array antenna as claimed in claim 12 wherein the output voltage amplitudes and the arrangement of said M groups of power modules are selected by treating the M module group arrangements as comprising a superposition of M elliptically shaped, overlapping zones having the same boundaries as corresponding ones of the M groups of modules, each of said M zones having associated therewith a different voltage amplitude $E_i$, the voltage amplitude of the power modules in each of said M groups being selected by adding the different voltage amplitudes, $E_i$, of the corresponding overlapping zones, wherein the subscript "i" refers to the ith zone.

20. The array antenna as claimed in claim 19 wherein the voltage amplitudes, $E_i$, and semi-axis lengths, $a_i$ and $b_i$, are selected by application of the following far field equation to cause the sidelobe gain to be down at least about 30 dB from the mainlobe gain:

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are unit vectors in the sperical coordinate system and $k_o$ is the wave number associated with the radiated field.

21. The array antenna as claimed in claim 16 wherein the amplitudes $E_i$ and the semi-major and semi-minor axis lengths $a_i$ and $b_i$, respectively, are selected by application of the following far field equation so as to cause the sidelobe gain to be down at least about 30 dB from the mainlobe gain:

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are unit vectors in the sperical coordinate and $k_o$ is the wave number associated with the radiated field.

22. The array antenna as claimed in claim 13 wherein the number M of groups of power modules is about 5.

23. The process as claimed in claim 14 wherein the number M is between about 3 and about 7.

24. The process as claimed in claim 14 wherein the number M is about 5.

25. The process as claimed in claim 17 including treating the M groups of power modules as comprising a superposition of M elliptically shaped, overlapping zones having the same boundaries as corresponding ones of the M groups of modules, each of the M zones having associated therewith a voltage amplitude, $E_i$, and including treating the voltage amplitude of the power modules in each of the M groups of power modules as an additive superposition of the voltages amplitudes, $E_i$, of the corresponding overlapping zones, wherein the subscript "i" refers to the ith zone.

26. The process as claimed in claim 25 including using the following far field equation to obtain values for the zone voltages amplitudes, $E_i$, and the zone semi-major and semi-minor axis lengths, $a_i$ and $b_i$, which cause the far field sidelobe gain to be down at least about 30 dB from the corresponding far field mainlobe gain:

$$G(\theta,\phi) = [f(\theta,\phi)\,(a_\theta \cos\phi - a_\phi \sin\phi \cos\theta)]^2,$$

$$\text{wherein } f(\theta,\phi) = \sum_{i=1}^{M} 2\pi\, a_i\, b_i\, E_i\, J_1(u_i)/u_i,$$

$$u_i = (k_o\, a_i \sin\theta)\sqrt{\cos^2\phi + (b_i^2/a_i^2)\sin^2\phi},$$

$J_1(u_i)$ is the first order Bessel function, $\hat{a}_\theta$ and $\hat{a}_\phi$ are unit vectors in the sperical coordinate and $k_o$ is the wave number associated with the radiated field.

27. A process for configuring a low sidelobe, solid state, phased array antenna, the process comprising:

a) providing for an array antenna aperture, a large number, N, of small, closely spaced radiating apertures;

b) providing for each of the small radiating apertures a radiating element, N radiating elements being thereby provided;

c) providing for each of the N radiating elements a separate, active solid state power module;

d) dividing the power modules into M different elliptically-shaped power module groups of progressively larger sizes, the output voltage amplitudes of all the power modules in any of the M groups of modules being substantially the same and the output voltage amplitudes of power modules in different groups of modules being different such that each progressively larger group includes power modules having lower output voltage amplitudes than the next progressively smaller group; and e) arranging the M groups of power modules around a central point of the array so that the output voltage amplitudes of the M groups of power modules decrease with increasing distance from said central point.

28. The process as claimed in claim 15 wherein the number M is between 3 and about 10.

29. The process as claimed in claim 15 wherein the number M is about 5.

30. The array antenna as claimed in claim 13 wherein the M groups of power modules are concentrically arranged around the central point of the array.

31. The process as claimed in claim 14 including concentrically arranging the M groups of power modules around the common point of the array.

* * * * *